US005250772A

United States Patent [19]

Booske

[11] Patent Number: 5,250,772

[45] Date of Patent: Oct. 5, 1993

[54] MICROWAVE FURNACE WITH UNIFORM POWER DISTRIBUTION

[75] Inventor: John H. Booske, Madison, Wis.

[73] Assignee: Wisconsin Alumni Research Foundation, Madison, Wis.

[21] Appl. No.: 948,169

[22] Filed: Sep. 21, 1992

[51] Int. Cl.[5] ..... H05B 6/64

[52] U.S. Cl. ..... 219/10.55 R; 219/10.55 F

[58] Field of Search ..... 219/10.55 R, 10.55 A, 219/10.55 E, 10.55 F

[56] References Cited

U.S. PATENT DOCUMENTS

| | | | |
|---|---|---|---|
| 2,956,144 | 10/1960 | Woodman | 219/10.55 R |
| 3,402,277 | 9/1968 | Muller | 219/10.55 A |
| 3,560,695 | 2/1971 | Williams et al. | 219/10.55 A |
| 3,851,131 | 11/1974 | Johnston et al. | 219/10.55 A |
| 3,855,440 | 12/1974 | Staats et al. | 219/10.55 F |
| 3,975,606 | 8/1976 | Tanaka et al. | 219/10.55 F |
| 4,370,534 | 1/1983 | Brandon | 219/10.55 A |
| 4,490,923 | 1/1985 | Thomas | 219/10.55 R |
| 4,631,380 | 12/1986 | Tran | 219/10.55 A |
| 4,762,973 | 8/1988 | Schultz | 219/10.55 E |
| 4,908,486 | 3/1990 | Fry | 219/10.55 A |
| 5,003,143 | 3/1991 | Marks et al. | 219/10.55 A |

*Primary Examiner*—Philip H. Lueng

*Attorney, Agent, or Firm*—Andrus, Sceales, Starke & Sawall

[57] ABSTRACT

A microwave furnace having uniform power distribution via the induction of ergodic modes includes a base portion and a pair of planar spaced apart elongated sidewalls that extend upwardly from the base, with the distance between the sidewalls being within ±20% of the length of the sidewalls. A pair of arcuate end-walls are disposed at each end of the sidewalls with the end-walls having a radius of curvature within ±20% of one-half of the length of the sidewalls. A domed cover having a radius of curvature within ±20% of one-half of the length of the sidewalls rests atop the intermediate portion.

5 Claims, 2 Drawing Sheets

MICROWAVE FURNACE WITH UNIFORM POWER DISTRIBUTION

BACKGROUND OF THE INVENTION

The present invention relates to microwave furnaces and more particularly to a microwave furnace design that provides uniform power distribution within the furnace cavity.

When microwaves are applied into a closed space, such as a home microwave oven, a number of regular power distributions are created by the formation of standing waves having power peaks and valleys, with the valleys having little or no power intensity and the peaks having maximum power intensity. These distributions or modes overlap with one another in time effectively smearing out the power distribution. In order to achieve power uniformity in a "regular cavity", i.e. one with a conventional geometric shape, such as a cylinder or rectangular box, approximately one hundred modes need to be developed within the cavity. The number of modes are roughly governed by the equation:

$M=L/\lambda$ where M is the number of modes, L is the characteristic dimension of the cavity and $\lambda$ is the wave length of the radiation.

For a home microwave oven with a wave length of ten cm. (2.4 GHz.) to achieve one hundred modes, the characteristic box dimension L would need to be on the order of ten meters. Obviously, a home microwave oven is not quite this big. To achieve a regular cavity in this case, a "mode mixer" in the form of a fan acts to chop up the incoming microwaves. The resulting random distribution of modes helps to achieve a more regular distribution of energy.

The degree of regularity necessity for a home oven is not very great because of the nature of the materials being heated. The mechanical and thermal properties of food and the cooking temperatures of generally less than two hundred degrees centigrade make the occurrence of short-lived "hot spots" less critical. However, for industrial applications, such as the sintering of ceramic materials at temperatures greater than five hundred degrees centigrade, a thermal gradient within the sintering body of less than fifty degrees centigrade could be enough to induce cracking due to uneven thermal expansion. Additionally, when ceramic materials get hotter, their absorption of microwaves increases non-linearly. This can lead to a condition called thermal runaway, where the development of a hot spot can be self-propagating and cause localized melting, unequal densification during sintering, and poor quality sintered bodies.

Recently it has been found that ergodic modes can be utilized in a microwave oven rather than regular modes. Ergodic modes, while temporally coherent are not spatially coherent. Thus ergodic modes will not have a simple power distribution in space. Rather than appearing as regularly spaced regions of high and low power, ergodic modes will be essentially randomly spread around the cavity. This distribution of intensity for each ergodic mode means that fewer modes must overlap in order to obtain a regular power distribution within the cavity.

While regular modes will occur for simple shapes such as cubes, cylinders or spheres, the optimal ergodic modes will occur for a shape such as a "stadium". Shapes of this type will produce a uniform power distribution for values of M of only ten which means the value of L can be reduced to practical dimensions.

It is an object of the present invention to provide a microwave furnace design that induces the occurrence of ergodic modes so as to allow for an industrial microwave furnace having a practical characteristic dimension.

SUMMARY OF THE INVENTION

A microwave furnace designed to induce the occurrence of ergodic modes includes a substantially planar base and an intermediate portion having planar spaced apart elongated sidewalls extending from the base with the distance between the sidewalls being within ±20% of the length of the sidewalls.

In accordance with another aspect of the invention, the height of the sidewalls is within ±20% of one-half of the length of the sidewalls.

In accordance with yet another aspect of the invention, the intermediate portion is provided with a pair of arcuate end-walls extending upwardly from the base and disposed at each end of the sidewalls. The end-walls have a height substantially equal to that of the sidewalls and a radius of curvature ±20% of one-half of the distance between the sidewalls.

In accordance with yet another aspect of the invention, the microwave furnace includes a domed cover that is co-extensive with the perimeter of the intermediate portion and has a radius curvature within ±20% of one-half of the length of the sidewalls.

In accordance with yet another aspect of the invention, means are provided for introducing microwaves into the chamber defined by the base, the intermediate portion and the cover.

The present invention thus provides a microwave furnace design that by its very nature induces the occurrence of ergodic microwave modes.

BRIEF DESCRIPTION OF THE DRAWINGS

The drawings illustrate the best method presently contemplated of carrying out the invention.

In the drawings.

DETAILED DESCRIPTION OF THE PREFERRED EMBODIMENT

Figure 1:
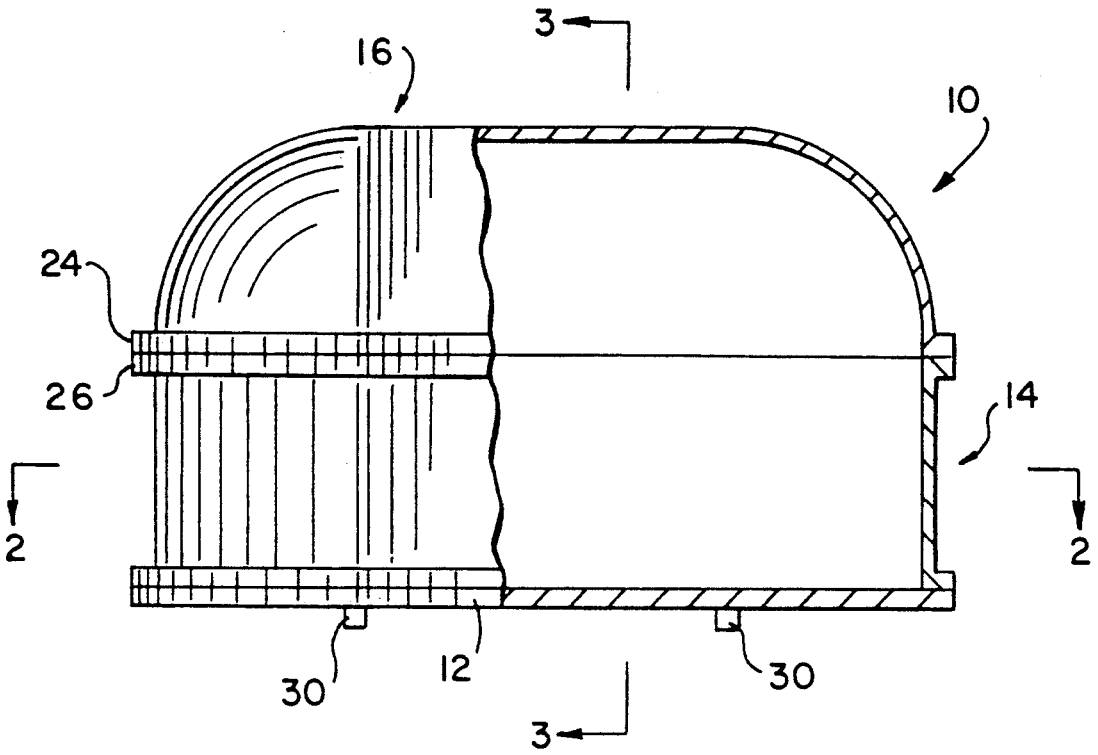
FIG. 1 is a side view with parts broken away of a microwave furnace constructed according to the present invention.
Figure 2:
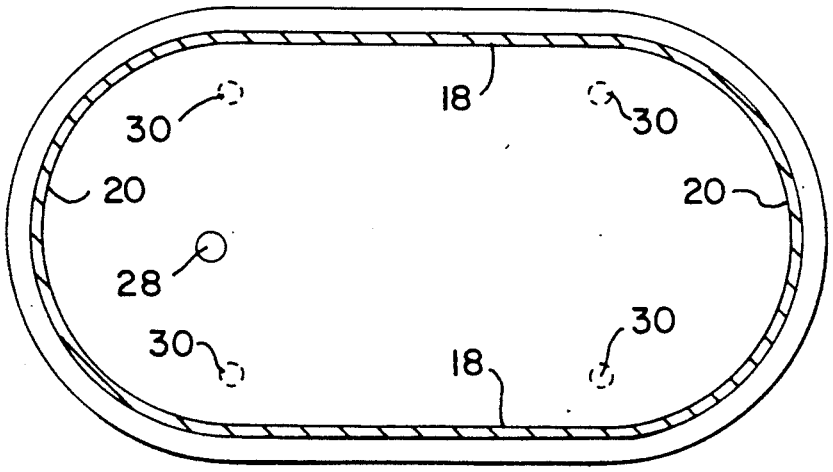
FIG. 2 is a sectional view along the line 2—2 of FIG. 1.
Figure 3:
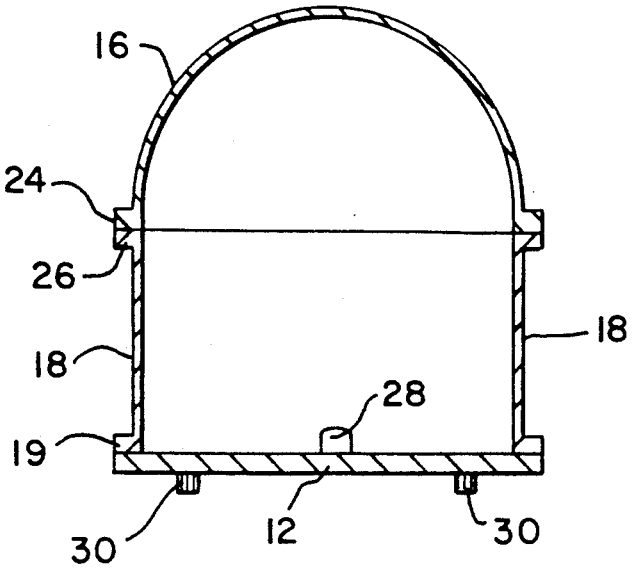
FIG. 3 is a sectional view along the line 3—3 of FIG. 1.
Figure 4:
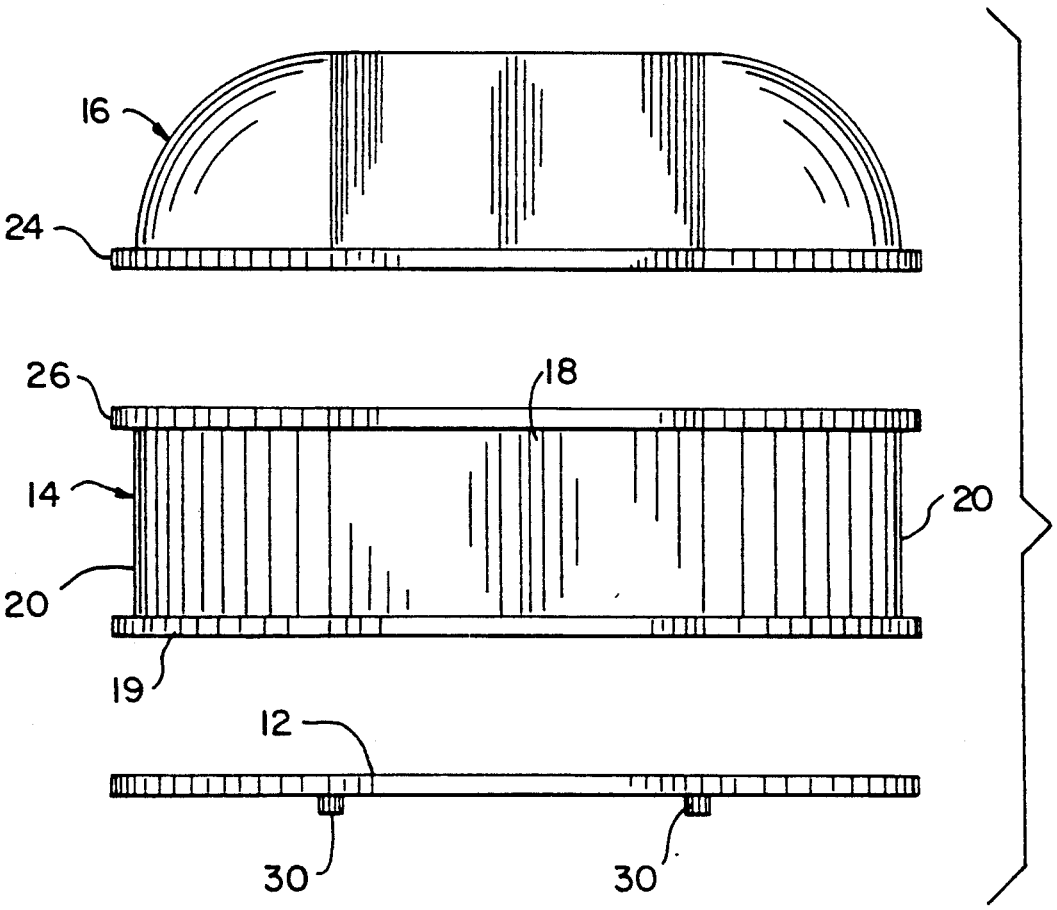
FIG. 4 is an exploded view of the microwave furnace of FIG. 1.

As shown in FIGS. 1-3, a microwave furnace 10 includes a substantially planar base portion 12, an intermediate portion 14 and a domed cover 16.

Intermediate portion 14 includes a pair of substantially planar spaced apart elongated sidewalls 18 that extend upwardly a distance "H" from base 12. In accordance with the invention, the distance "W" between sidewalls 18 is substantially equal to the length "L" of sidewalls 18 and the height "H" of sidewalls 18 is substantially equal to one-half the length "L" of sidewalls 18.

Sidewalls 18 are connected by a pair of arcuate end-walls 20 having a height equal to that of sidewalls 18 and a radius of curvature "r" substantially equal to one-half the length of sidewalls 18.

A flange 19 runs along the lower edge of intermediate portion 14 to provide a surface that engages and rests on base portion 12.

Domed cover 16 is provided with a flange 24 that is co-extensive with and rests upon flange 26 at the top of intermediate portion 14. Domed cover 16 is removable from intermediate portion 14 and is provided with a radius of curvature "R" that is substantially equal to one-half of the length "L" of sidewall 18.

Microwaves in the frequency range of 14 GHz. are introduced into the furnace cavity by means of microwave tube 28 that is located off center and in the base 12 of furnace 10. Microwave tube 28 is canted slightly so as to introduce the microwaves into the cavity at an angle.

Base portion 12 is elevated from any supporting surface by means of feet 30. This elevation allows for the circulation of air and the cooling of furnace 10. Furnace 10 can be constructed of brass or any other highly conductive material.

While the ratios between radii of curvature, height of walls, separation of walls and length of walls has been spoken of in terms of "substantially equal" or "substantially equal to one-half", it should be understood that the ratios can vary in a range of ±20% and still provide ergodic waves within the cavity. The present invention thus provides a furnace capable of inducing ergodic waves from a source of standing microwaves and yet having realistic dimensions, e.g. W=40 cm., L=40 cm., H=20 cm. and R and r=20 cm.

Various modes of carrying out the invention are contemplated as being within the scope of the following claims particularly pointing out and distinctly claiming the subject matter regarded as the invention.

I claim:

1. A microwave furnace having uniform power distribution comprising:

a substantially planar base, an intermediate portion comprising:

a pair of substantially planar spaced apart elongated sidewalls extending upwardly from said base, the distance between said sidewalls being within ±20% of the length of said sidewalls and the height of said sidewalls being within ±20% of one-half of the length of each of said sidewalls and a pair of arcuate spaced apart end-walls extending upwardly from said base and disposed at each end of said sidewalls, said end-walls having a height substantially equal to said sidewall height and a radius of curvature within ±20% of one-half of said distance between said sidewalls, a domed cover co-extensive with the perimeter of said intermediate portion and having a radius of curvature within ±20% of one-half of the length of each of said sidewalls, and means disposed within the furnace for introducing microwaves into the chamber defined by said base, said intermediate portion and said cover.

2. The microwave furnace defined in claim 1 wherein said planar base is removably connected to said intermediate portion.

3. The microwave furnace defined in claim 1 further comprising a plurality of feet disposed on said planar base so as to elevate said furnace from any supporting structure.

4. The microwave furnace defined in claim 1 wherein the length of said sidewalls is substantially equal to the distance between said sidewalls and the height of said sidewalls is substantially equal to the radius of curvature of said end-walls which is substantially equal to one-half the length of said sidewalls and the radius of curvature of said domed cover is substantially equal to the height of said sidewalls.

5. The microwave furnace defined in claim 1 wherein said domed cover is removably disposed atop said intermediate portion.

* * * * *